US005311950A

United States Patent [19]

Spektor

[11] Patent Number: 5,311,950

[45] Date of Patent: May 17, 1994

[54] DIFFERENTIAL PNEUMOPERCUSSIVE REVERSIBLE SELF-PROPELLED SOIL PENETRATING MACHINE

[76] Inventor: Michael B. Spektor, 1030 Tamera Dr., Klamath Falls, Oreg. 97603

[21] Appl. No.: 47,993

[22] Filed: Apr. 19, 1993

[51] Int. Cl.[5] ..... E21B 1/00

[52] U.S. Cl. ..... 175/19; 173/137

[58] Field of Search ..... 175/19, 293-297; 173/135, 137, 206

[56] References Cited

U.S. PATENT DOCUMENTS

| | | | |
|---|---|---|---|
| 3,651,874 | 3/1972 | Sudnishnikov et al. . | |
| 3,708,023 | 1/1973 | Nazarov et al. . | |
| 3,727,701 | 4/1973 | Sudnishnikov et al. . | |
| 3,744,576 | 7/1973 | Sudnishnikov et al. . | |
| 3,756,328 | 9/1973 | Sudnishnikov et al. . | |
| 3,865,200 | 2/1975 | Schmidt . | |
| 4,078,619 | 3/1978 | Sudnishnikov et al. . | |
| 4,214,638 | 7/1980 | Sudnishnikov et al. . | |
| 5,031,706 | 7/1991 | Spektor | 175/19 |
| 5,226,487 | 7/1993 | Spektor | 175/19 |

OTHER PUBLICATIONS

Minimization of Energy Consumption of Soil Deformation, *Journal of Terramechanics,* 1980, vol. 17, No. 2, pp. 63-77.

Principles of Soil-Tool Interaction, *Journal of Terramechanics,* 1981, vol. 18, No. 1, pp. 51-65.

Motion of Soil-working Tool Under Impact Loading, *Journal of Terramechanics,* 1981, vol. 18, No. 3, pp. 133-156.

Working Processes of Cyclic-Action Machinery for Soil Deformation—Part I, *Journal of Terramechanics,* 1983, vol. 20, No. 1, pp. 13-41.

Minimum Energy Consumption of Soil Working Cyclic Processes, *Journal of Terramechanics,* 1987, vol. 24, No. 1, pp. 95-107.

*Primary Examiner*—Thuy M. Bui

[57] ABSTRACT

The invention represents a differential pneumopercussive self-propelled reversible soil penetrating machine (100) having essentially higher efficiency, reliability, durability, and controllability compared to conventional machines. All of these achievements are associated in part with the development of an innovative differential air-distributing mechanism (106) which inherently allows for relatively long strokes of the striker (104) resulting in relatively high impact energy of the striker. The operation of this mechanism is based on the difference between the pressures in the two separate nominal (high) and reduced (low) pressure air lines which deliver compressed air to the machine. In order to switch over the machine (100) from the forward to the reverse mode operation or vice versa it is just necessary to adjust properly the pressure in the reduced (low) pressure air line by a conventional air pressure regulator associated with the source of compressed air. Since the differential air-distributing mechanism does not need a mode control device and a separate exhaust channel for the reverse mode operation, the machine (100) is considerably simplified. The invention also provides a directional sensor (165) informing the operator about the deviation of the machine (100) from the desired trajectory and a rear anvil assembly (105) which is rigidly connected with the housing (101) and eliminates impact loading from the body parts of the differential air-distributing mechanism and the tail nut (152). This makes it possible to manufacture these body parts of soft and plastic materials.

19 Claims, 7 Drawing Sheets

SECTION 2-2

SECTION 1-1

SECTION 5-5

SECTION 4-4

SECTION 3-3

SECTION 6-6

DIFFERENTIAL PNEUMOPERCUSSIVE REVERSIBLE SELF-PROPELLED SOIL PENETRATING MACHINE

FIELD OF THE INVENTION

The present invention relates to vibro-percussive pneumatic self-propelled soil penetrating machinery used for underground hole making, driving pipes, cables, or explosives into the holes.

BACKGROUND OF THE INVENTION

Pneumopercussive cyclic action reversible self-propelled soil penetrating machines are known. In general, these machines comprise a hollow cylindrical body, having a pointed front part, a striker reciprocating inside the body, and an air distributing mechanism. A machine operation cycle includes a forward and backward stroke of the striker. In the forward mode of operation, the striker at the end of its forward stroke imparts an impact to the front end of the body resulting in an incremental body soil penetrating. During the backward stroke, the striker is braked by an air buffer in order to prevent or minimize an impact to the internal rear end of the body. In the reverse mode operation the striker is braked during its forward stroke to eliminate an impact. However, it accelerates during the backward stroke and imparts an impact to the internal rear end of the body so that the body moves backward a certain increment of displacement.

A pneumatic reversible machine of this type is described in U.S. Pat. No. 3,651,874 issued to Sudnishnikov et al. in March, 1972. The machine operation is based on a valveless air distributing mechanism causing relatively short strokes of the striker. The machine has inherent disadvantages which are discussed in numerous subsequent patents. The most significant disadvantages consist of insufficient impact energy resulting in high energy consumption at low productivity of the machine, non-reliable reverse mechanism, and low durability.

U.S. Pat. No. 3,708,023 issued to Nazarov et al. in January, 1973, and also U.S. Pat. No. 3,865,200 issued to Schmidt in February, 1975, relate to the impact energy problem. However, the solutions offered in these patents appear unsuccessful. Therefore, the impact energy problem associated with high energy consumption and low productivity remains unsolved.

U.S. Pat Nos. 3,727,701 (April 1973); 3,744,576 (July 1973); 3,756,328 (September 1973); 4,078,619 (March 1978); 4,214,638 (July 1980); issued to Sudnishnikov et al. illustrate the problems of the reverse mechanism suggesting some improvements. A series of U.S. Patents also dealing with the reverse mechanism has been issued to different authors during the past 15 years. However, the basic problems of the reverse mechanism associated with the control and extremely low impact energy of this mechanism remain unsolved. A detailed analysis of these patents is presented in the U.S. Pat. No. 5,031,706 issued to Spektor (the author of the present invention) in July, 1991. This patent also illustrates numerous additional disadvantages of the existing machines which are based on the U.S. Pat. No. 3,756,328.

Analysis of energy consumption and productivity of the working process of the existing machines (based on the research investigations, published by the present inventor), shows that the mentioned working process is characterized by relatively high energy consumption at relatively low productivity (average velocity). The theory of minimization of energy consumption of soil working cyclic processes, developed and published by the present inventor, indicates that the process of vibratory soil penetration can be optimized with respect to minimum energy consumption. (See: Minimization of Energy Consumption of Soil Deformation, Journal of Terramechanics, 1980, Volume 17, No. 2, pages 63 to 77; Principles of Soil-Tool Interaction, Journal of Terramechanics, 1981, Volume 18, No. 1, pages 51 to 65; Motion of Soil-Working Tool Under Impact Loading, Journal of Terramechanics, 1981, Volume 18, No. 3, pages 133 to 136; Working Processes of Cyclic-Action Machinery for Soil Deformation-Part I, Journal of Terramechanics, 1983, Volume 20, No. 1, pages 13 to 41; Minimum Energy Consumption of Soil Working Cyclic Processes, Journal of Terramechanics, 1987, Volume 24, No. 1, pages 95 to 107). Applying the mentioned theory to the existing machines in order to optimize the parameters shows that the impact energy of the striker should be significantly increased. This could be achieved by an appropriate increase of the stroke of the striker (without increasing the nominal pressure of the compressor). However, the valveless air-distributing mechanism of the existing hole making machines makes it almost impossible to increase the stroke of the striker to a considerable extent. A detailed discussion of this problem is presented in U.S. Pat. No. 5,031,706 offering a reversible soil penetrating machine provided by an air-distributing mechanism that should allow for a relatively long stroke of the striker. The housing of the mentioned machine has three longitudinal slots machined on its external lateral surface. These slots are hermetically covered and are used as air passages. According to an alternative embodiment, the housing consists of an outer and inner tube. The inner tube, having tree longitudinal slots on its external surface, is pressed into the outer tube creating three separate longitudinal channels. One of these channels alternatively delivers compressed air to the backward stroke chamber during the backward stroke of the striker or connects the backward stroke chamber with the atmosphere during the forward stroke of the striker. The second channel is used for exhaust of the compressed air from the forward stroke chamber at the end of the forward stroke of the striker in the forward mode operation of the machine. The third channel is intended for exhaust of compressed air from the forward stroke chamber at the forward stroke of the striker in the reverse mode of operation.

The front anvil of this machine comprises a moveable chisel. The striker is reciprocating inside of inner tube. The rear anvil represents a part of the air-distributing mechanism. This mechanism has a spring loaded stroke control valve that cyclicly reciprocates opening and overlapping appropriate ports, directing the compressed air to the forward or backward stroke chambers, and also connecting the backward stroke chamber with the atmosphere. The air-distributing mechanism comprises three separate air hoses. One hose delivers compressed air at the nominal pressure which is used for the forward stroke of the striker and also for governing the stroke control valve. The second hose delivers compressed air at a reduced pressure which is only used for the backward stroke of the striker (the lowered air pressure does not take part in governing the stroke control valve). The third hose delivers compressed air at the nominal pressure to a spring loaded mode control valve and switches over the machine from forward to reverse mode operation.

Several prototypes of this machine have been built and tested. These prototypes demonstrated very low efficiency at the forward mode operation due to insufficient impact energy of the striker. The testing procedures made it possible to understand and to explain the reasons why the striker was not gaining the precalculated energy during its forward stroke. The explanations are as follows. It was assumed that during the forward stroke of the striker the pressure in the forward stroke chamber should have been equal or close to the nominal pressure. At this condition, the air pressure on the left and right ends of the stroke control valve would have been equal and the valve would have been held in its extreme left position being pushed by the spring. This would have allowed the striker to be accelerated all the way along the length of the forward stroke chamber. However in reality, this assumption is incorrect. The tests show that during the forward stroke of the striker the pressure in the forward stroke chamber starts to drop shortly after the striker begins to move forward. The left end of the striker is at all times under the nominal pressure of the system. As soon as the pressure inside the forward stroke chamber, which is connected with the right end of the valve, drops to a level where the nominal pressure force applied to the left side of the valve exceeds the spring compression force, the valve moves to its extreme right position. This stops the air supply to the forward stroke chamber and opens the ports for compressed air delivery to the backward stroke chamber. The striker, still being far away from the end of its forward stroke, is now braked by the compressed air in the backward stroke chamber. All this causes a low impact energy of the striker. It is obvious that the striker would have more impact energy if its stroke would be longer. However, the prototype built according to U.S. Pat. No. 5,031,706 actually also has a short stroke mechanism which, as it is shown above, does not provide sufficient impact energy required for optimization of the working process of the underground hole making machines.

The attempt to apply a stronger spring to the stroke control valve was also unsuccessful. The stronger spring caused an early switch over from the backward stroke to the forward stroke of the striker, which resulted in a shortening of the forward stroke, and consequently, reduced the efficiency of the working process.

Thus, the energy problem associated with the minimization of the energy consumption at an increase of the productivity of the working process of the underground hole making machines remains unsolved.

Another disadvantage of the considered machine is associated with the control of forward and reverse mode operation. The need of the third air hose, the mode control valve, and the separate exhaust channel for the reverse mode operation complicates the machine, increasing the cost of its manufacturing and maintenance. In addition to this, it should be noted that the tests have shown that the available cross-sectional area of the exhaust channel for the forward mode operation is insufficient. An essential air pressure remains inside the forward stroke chamber after the exhaust. This causes an early switch over from the backward stroke to the forward stroke, decreasing the stroke of the striker.

A further disadvantage of the considered machine is the need of special equipment for pressing in the inner tube into the outer tube. These tubes are relatively long and require unconventional and costly equipment to press one tube into another.

Another disadvantage of the considered machine is associated with the annular resilient gasket which is intended to prevent penetration of soil between moveable components of the chisel assembly. This gasket is located on a cylindrical surface and is compressed in the axial direction by two components which are in relative cyclic reciprocation during the machine operation. Thus this gasket is subjected to cyclic loading and is often pushed out from its original location, and sometimes it cracks and moves away.

Another disadvantage of the considered machine is associated with the need of a complicated solenoid type frequency sensor.

Still another inherent disadvantage of known reversible underground hole making machines is that in the reverse mode operation the striker imparts impacts to the rear anvil which represents a part of the air-distributing mechanism. These impacts are transferred to the tail nut of the machine through the body parts of the air-distributing mechanism. This often causes loosening of the nut with a subsequent failure of the air-distributing mechanism. Besides this, the mentioned body parts should be made of strong materials with high toughness.

One more inherent disadvantage of conventional underground penetrating machines is the lack of means to signal about the deviation from the initial trajectory.

The present invention offers solutions to eliminate these disadvantages. These solutions are based on the testing of full scale real prototypes in laboratory and field conditions. The results of testing convincingly confirm the reliability and efficiency of the incorporated engineering solutions.

Implementation of the present invention will significantly increase the efficiency of the working process of the underground pneumatically operated self-propelled soil penetrating machines.

SUMMARY OF THE INVENTION

The invention offers a pneumopercussive differential self-propelled reversible cyclic-action soil penetrating machine, having an essentially increased efficiency and reliability in comparison with the existing machines. This is achieved in part by a new differential valve operated air-distributing mechanism which allows for an almost unlimited stroke of striker. The principle of action of this mechanism is based on the use of the difference between the nominal and reduced pressures of the compressed air, delivered by two separate hoses to the air-distributing mechanism. Due to the use of this pressure difference, this new air-distributing mechanism and the new machine is named DIFFERENTIAL.

A further aspect of the invention is associated with simplified control of modes operation of the machine. The differential valve operated air-distributing mechanism provides control of the forward and reverse modes operation of the machine without any use of additional devices like mode control mechanism etc. Neither the mode control valve nor the third air hose are needed.

Another aspect of the invention represents an improvement of the compressed air exhaust process at the end of the forward stroke of the striker. The differential valve operated air-distributing mechanism does not need a separate exhaust channel for the reverse mode operation. One exhaust channel is used for both the forward and backward modes operation. This made it possible to double the space of this exhaust channel, which resulted in improvement of the machine performance.

Another aspect of the invention relates to a significant facilitation of the assembling of the inner and outer tubes of the machine housing. Since there is no more a need for two separate exhaust channels, the annular space between the inner and outer tubes is subdivided only into two unequal parts. The larger part is intended for the exhaust channel. This is achieved by securing two longitudinal strips to the external surface of the inner tube. No machining operations are required to make longitudinal slots. The inner tube with the two longitudinal strips on it is freely inserted into the outer tube. There is no need for any pressing equipment and other devices in order to assemble the inner and outer tubes. All this significantly reduces the cost of manufacturing and assembling the machine.

Another aspect of the invention is the use of a miniature pressure transducer instead of a solenoid based system for sensing the machine operational frequency. This increases the reliability of the frequency sensing and also simplifies and reduces the cost of the machine.

Another aspect of the invention is that the rear anvil is separated from the air-distributing mechanism and is rigidly secured to the inner tube. This completely removes the impact loading from the body parts of the air-distributing mechanism and from the tail nut. This makes it possible to manufacture the air-distributing mechanism body parts and some other parts of aluminum alloys, plastic, or composite materials. All this makes the machine more reliable and reduces its manufacturing cost.

Another aspect of the invention is that in order to prevent penetration of soil between the moveable components of the chisel assembly a special resilient bellows type diaphragm is installed between the two components which are in relative cyclic reciprocation and also a dynamic O-ring is placed to seal the radial gap between the moveable components. This diaphragm is subjected to relatively small bending stresses which are to a considerable extent less destructive than the essential compression stresses applied to the annular gasket mentioned above. Instead of the bellows type diaphragm an appropriate set of Belleville springs can be used.

An additional feature of the invention is a sensor mounted on the machine which provides the machine operator with current information about the deviation of the machine from the required straight line trajectory. This is achieved by a deformation transducer assembled in the tail nut. The transducer represents an electrical tensiometer which generates an electrical signal corresponding to the deformation of the thin-walled part of the tail nut. Appropriate calibration of this electrical signal can be interpreted in terms of the radius of the curvature of the trajectory and also in terms of angular deviation of the machine. This information is very helpful to make the appropriate operational decision.

All these and other aspects of the invention will become apparent from the detailed description of the illustrated embodiment.

BRIEF DESCRIPTION OF THE DRAWING

The invention will be further described with reference to the accompanying drawing.

FIGS. 1*a*, 1*b*, and 1*c*, of which FIG. 1*b* is a continuation of FIG. 1*a*, and FIG. 1*c* is a continuation of FIG. 1*b*, represent a longitudinal sectional view of a differential pneumopercussive self-propelled reversible soil penetrating machine according to the invention. The components of the machine are positioned for forward mode operation at the beginning of the forward stroke of the striker.

DESCRIPTION OF THE ILLUSTRATED EMBODIMENT

A. General Description

Figure 1A:
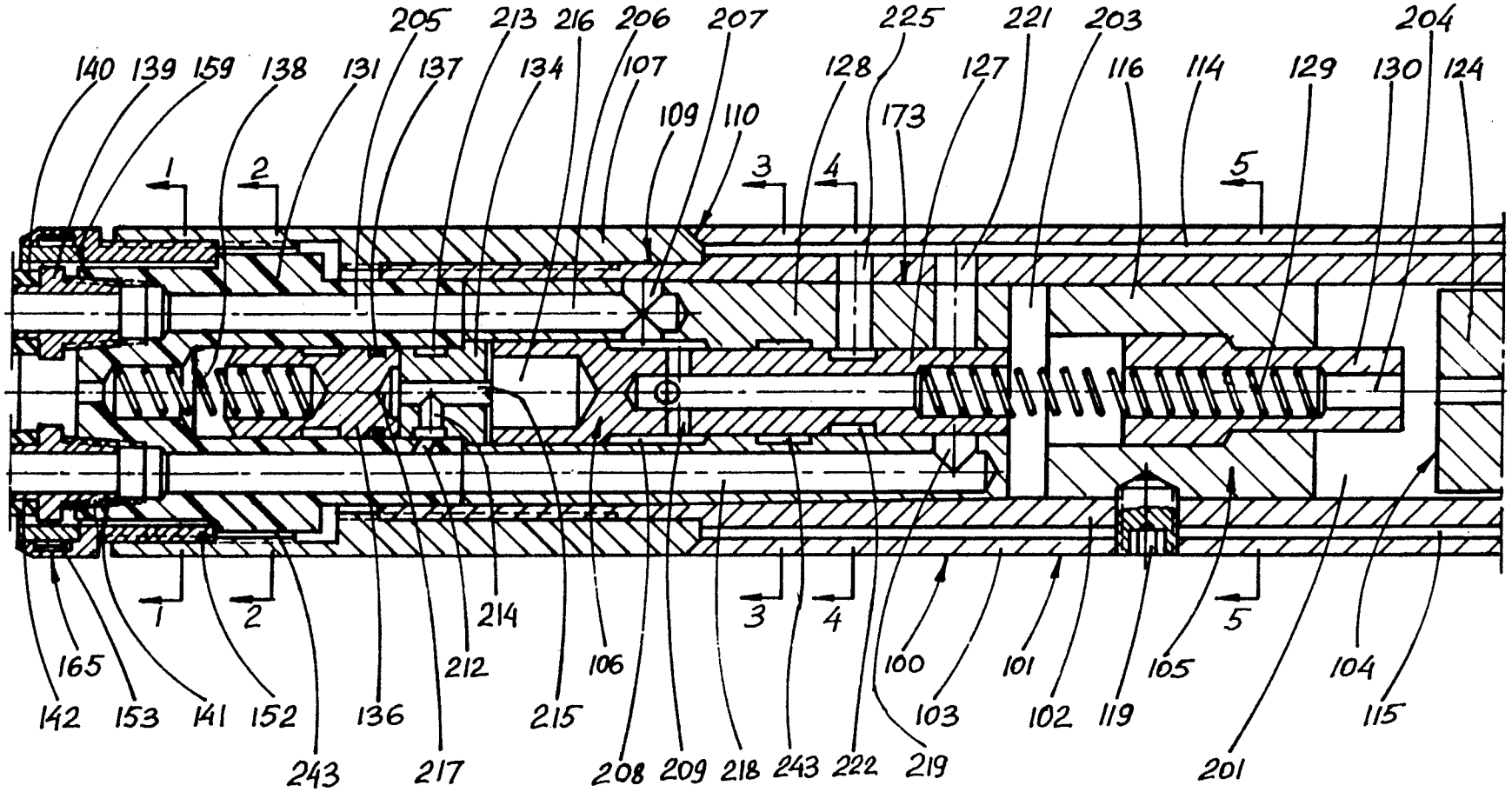
Figure 1B:
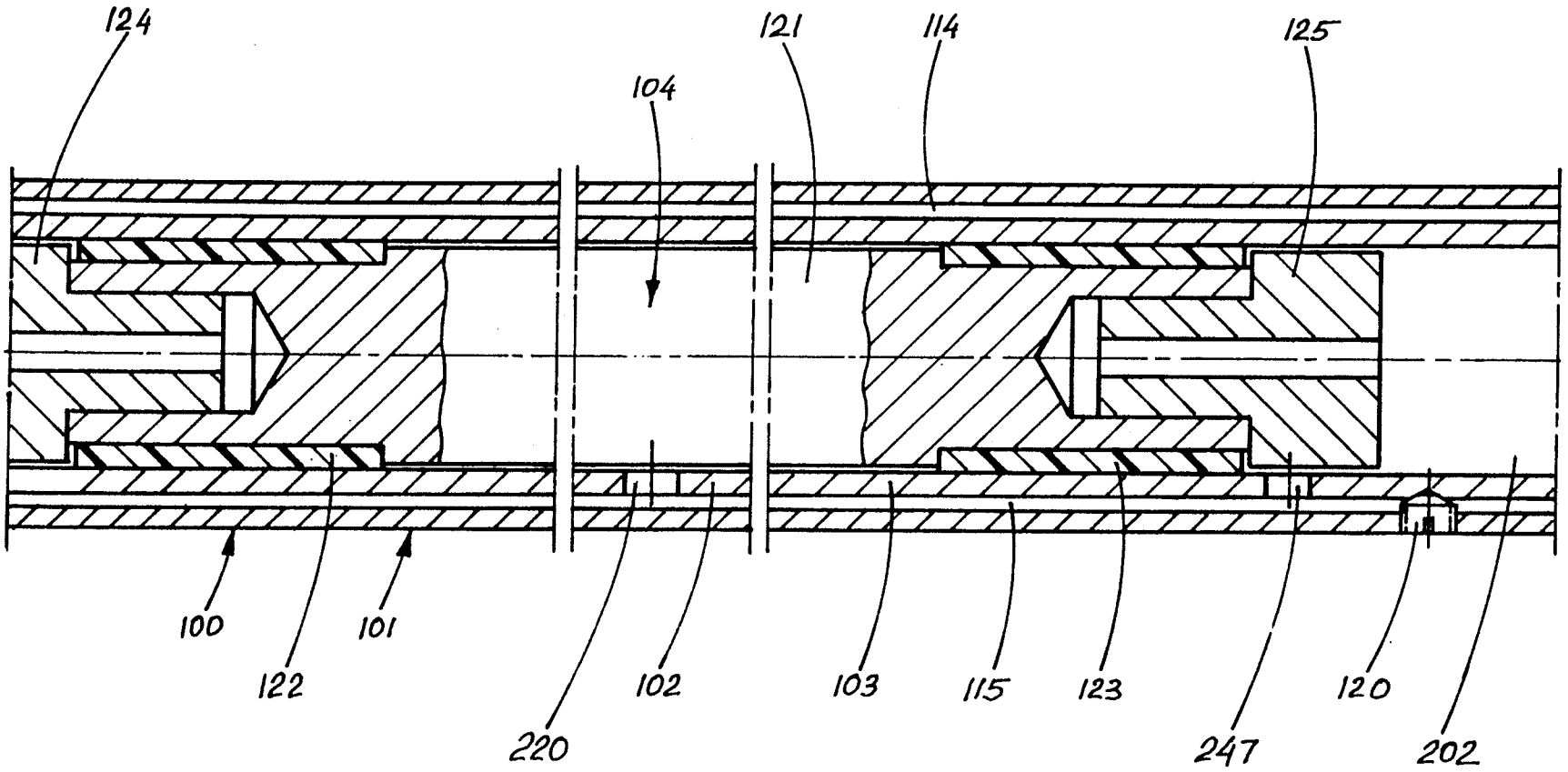
Figure 1C:
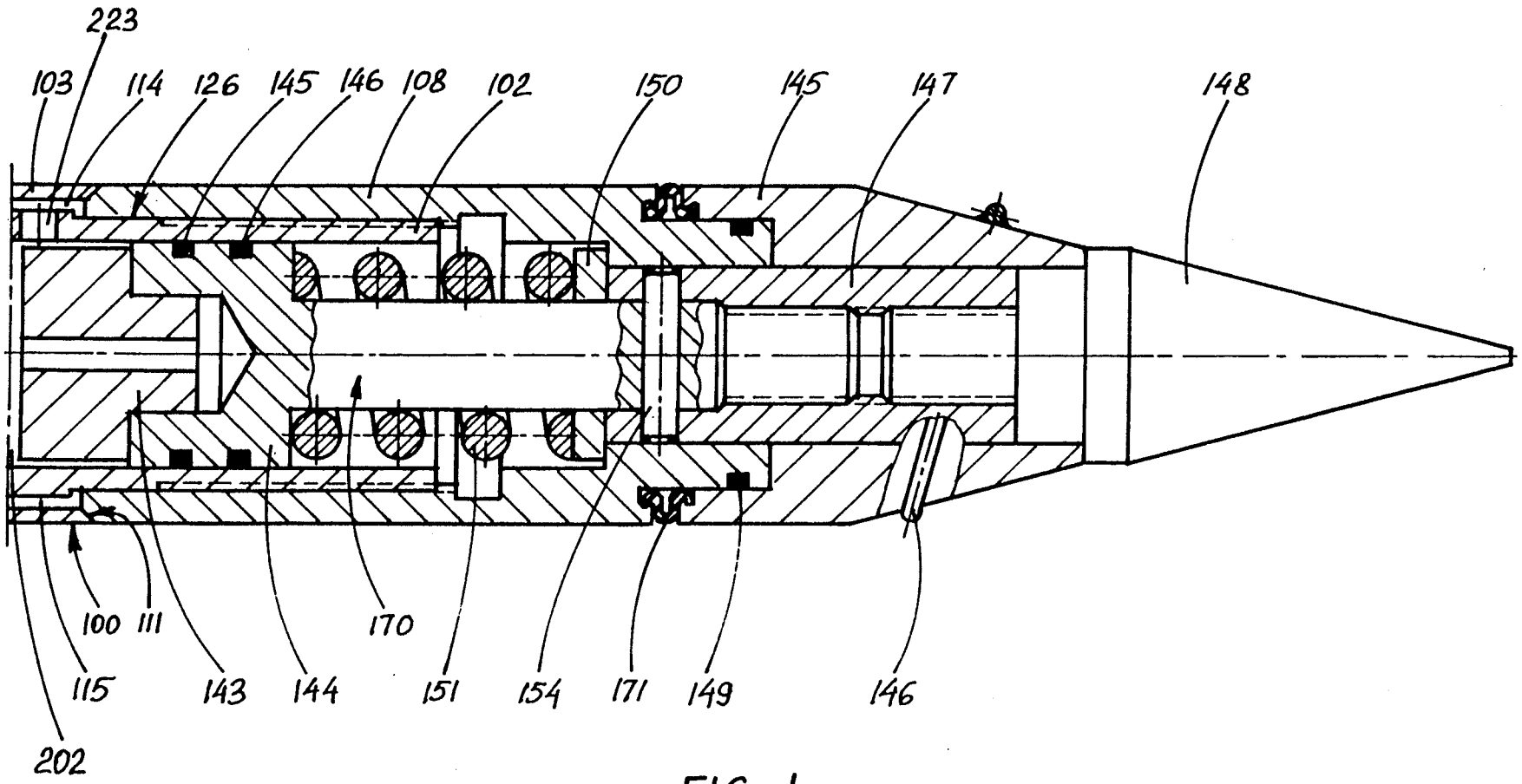
Figure 4:
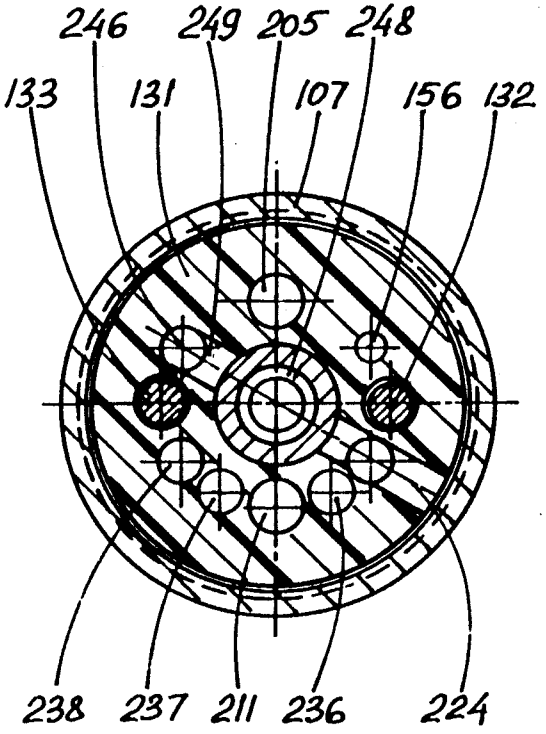
FIG. 4 is a cross-sectional view taken along the line 2—2 in FIG. 1*a*.
Figure 3:
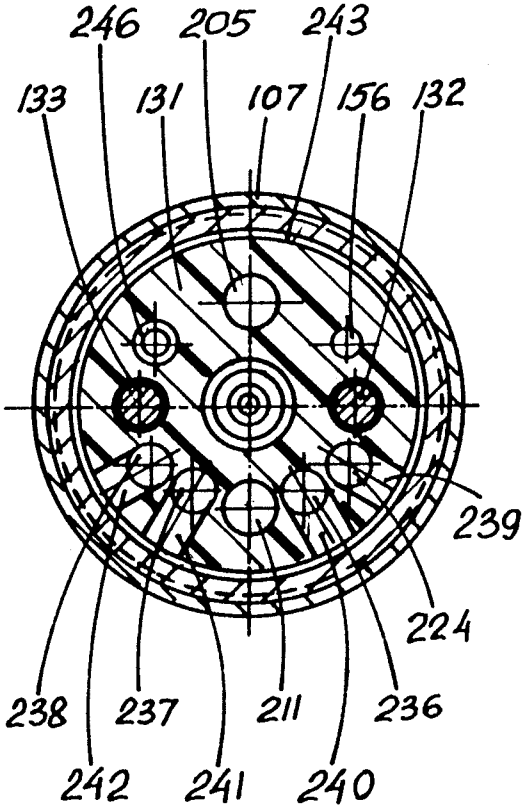
FIG. 3 is a cross-sectional view taken along the line 1—1 in FIG. 1*a*.

As shown in FIGS. 1*a*, 1*b*, and 1*c*, a differential pneumopercussive reversible self-propelled soil penetration machine 100 according to the invention includes, as major assemblies, an elongated compound housing assembly 101, comprising an inner tube 102 and an outer tube 103; a striker assembly 104 disposed for reciprocation within inner tube 102; a rear anvil assembly 105 rigidly secured to inner tube 102 rearwardly of striker assembly 104; a differential valve-operated air-distributing mechanism 106 secured in inner tube 102 rearwardly of rear anvil assembly 105 for supplying compressed air to reciprocate striker assembly 104; and a front anvil assembly 170. Each of these assemblies will hereafter be described in detail.

Figure 7:
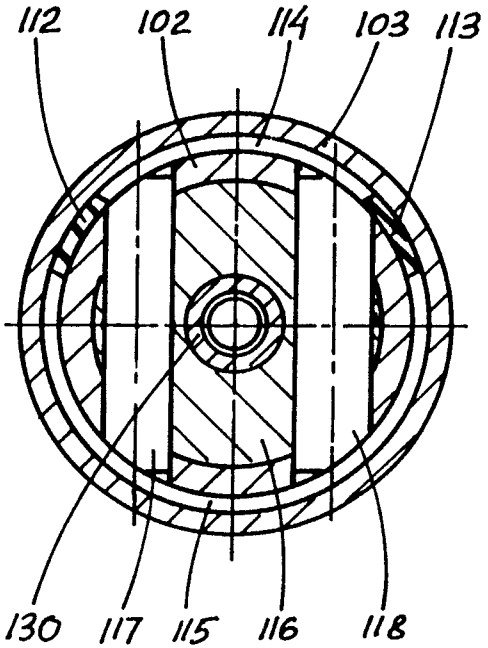
FIG. 7 is a cross-sectional view taken along the line 5—5 in FIG. 1*a*.
Figure 6:
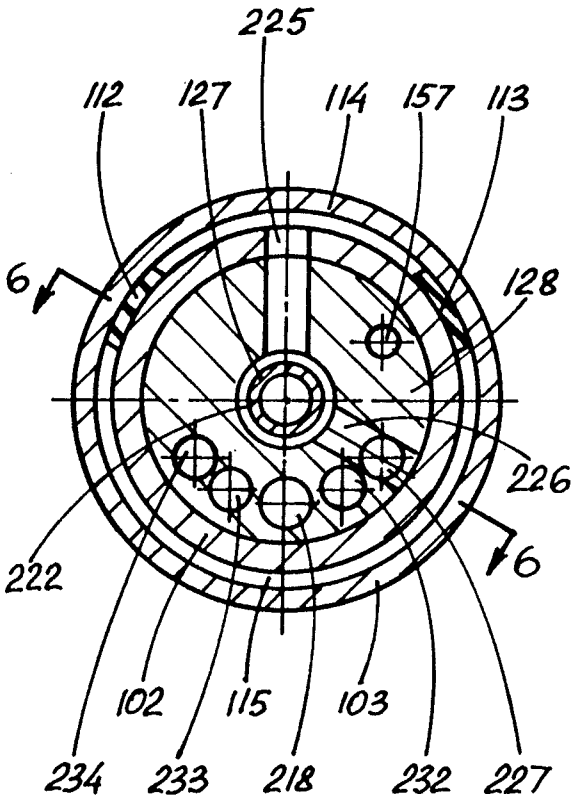
FIG. 6 is a cross-sectional view taken along the line 4—4 in FIG. 1*a*.
Figure 5:
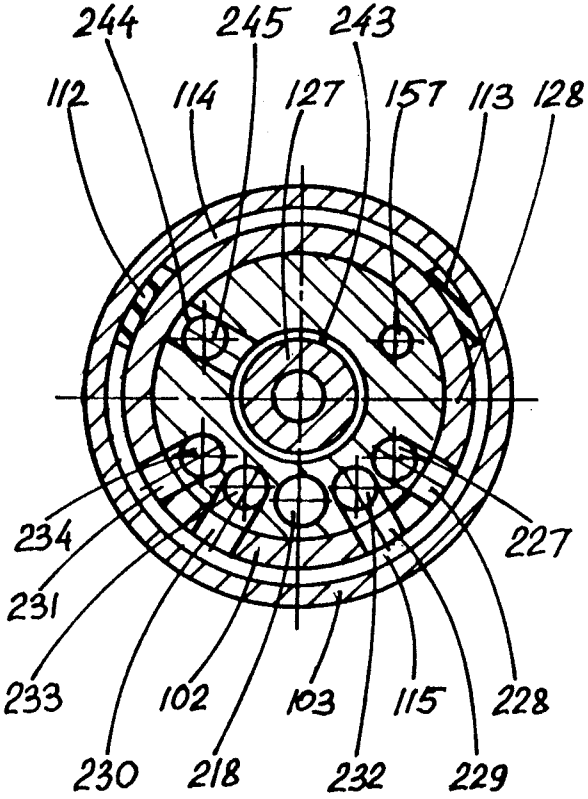
FIG. 5 is a cross-sectional view taken along the line 3—3 in FIG. 1*a*.
Figure 8:
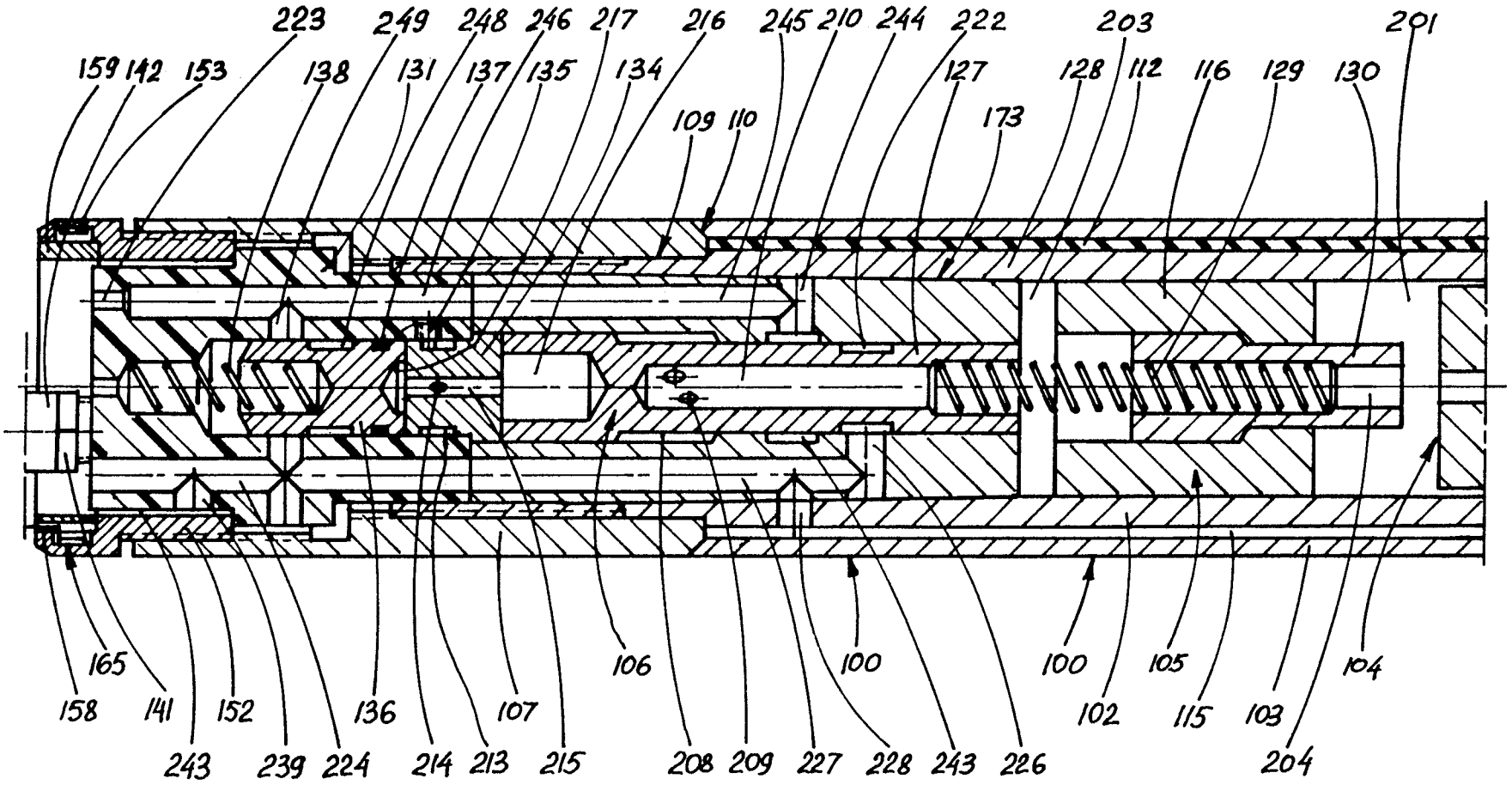
FIG. 8 is a revolved longitudinal sectional view along the line 6—6 in FIG. 6.

Referring to FIGS. 1*a*, 1*b*, 1*c*, and 3–8, inner tube 102 and outer tube 103 are concentrically mounted by means of a threaded rear guide sleeve 107 and a threaded front guide sleeve 108. As shown in FIGS. 1*a* and 8, threaded rear guide sleeve 107 is screwed against the stop on the rear part of inner tube 102 and it is centered by guiding surfaces 109 of inner tube 102 and rear guide sleeve 107, which has a centering chamfer 110 to fit to an appropriate chamfer of outer tube 103. Threaded front guide sleeve 108, as it is illustrated in FIG. 1*c*, is screwed on the front part of inner tube 102 against the stop on a centering chamfer 111 on outer tube 103 and centered by guiding surfaces 126 of inner tube 102 and front guide sleeve 108. Thus, inner tube 102 and outer tube 103 create a closed concentric annular space which is, as it is shown in FIGS. 1*a*, 1*b*, 1*c*, and 5–8, subdivided by two elastic longitudinal strips 112 and 113 into two unequal by space longitudinal air channels 114 and 115.

As shown in FIGS. 1*a*, 7, and 8, rear anvil assembly 105 includes a rear anvil 116, which is pressed into inner tube 102, and two pins 117 and 118, rigidly securing rear anvil 116 to inner tube 102.

As FIGS. 5–8 illustrate, longitudinal elastic strips 112 and 113 are cemented to the external surface of inner tube 102, and then the inner tube 102 with strips 112 and 113 on it and with rear anvil assembly 105 inside of it is freely inserted into outer tube 103, creating a little offset between these two tubes, which after that are centered by rear and front guide sleeves 107 and 108. Then the mutual position of outer tube 103, inner tube 102, and rear anvil 116 is fixed by a set-screw 119. In order to avoid deflection of inner tube 102, when compressed air is passing through channel 114, several set-screws 120, shown in FIG. 1*b*, support inner tube 102.

Referring now to FIG. 1*b*, striker assembly 104 comprises a striker 121; a rear bushing 122 and a front bushing 123, made of low-friction plastic material; a rear disposable bit 124 and front disposable bit 125, which are both made of hard shock-proof material. Bushings 122 and 123 are pressed on the journals of striker 121. Front and rear bits 124 and 125 are pressed into holes of striker 121. Striker assembly 104 is inserted into inner tube 102 through the front opening of tube 102.

Referring to FIGS. 1*a*, 2–6, and 8, differential air-distributing mechanism 106 includes a stepped spring loaded stroke control spool valve 127; a front valve chest 128, accommodating stroke control valve 127 for reciprocation, and is assembled with inner tube 102 by a conical fit 173, preventing air leakage between valve chest 128 and inner tube 102; a follower 130; a stroke control spring 129, exerting outward thrust on stroke control valve 127 and follower 130, disposed for reciprocation within rear anvil 116; a rear valve chest 131, secured to front valve chest 128 by two bolts 132 and 133; a centering step-bushing 134, which is pressed into rear valve chest 131 and secured by a set-screw 135, and centering front valve chest 128 by a slide fit assembly; a spring loaded relief valve 136 having a dynamic sealing O-ring 137; a spring 138 which is loading relief valve 136; a hose barb 139 with an air hose 140 for delivery of compressed air at the nominal (high) pressure from a source of compressed air; a hose barb 141 with an air hose 142 for delivery of compressed air at reduced (low) pressure from the source of compressed air through a conventional air pressure regulator (not shown in the drawing).

Assembling of air-distributing mechanism 106 may be performed in the following order. Relief valve 136 with spring 138 are accommodated by rear valve chest 131 and then plugged by inserting against a stop centering step-bushing 134 into rear valve chest 131. After that, centering step-bushing 134 is secured by set-screw 135. Then barbs 139 and 141 are screwed into rear valve chest 131. After that, stepped stroke control valve 127 is inserted into front valve chest 128. Then, front valve chest 128, being centered by step-bushing 134, is assembled with rear valve chest 131 by two bolts 132 and 133. Follower 130, accommodating spring 129, is inserted into rear anvil 116. After that, the assembly of rear and front chest valves 131 and 128, being guided by a pin (not shown in drawing), radially pressed into rear valve chest 131, and a slot (not shown in drawing), made in the rear threaded part of inner tube 102, is inserted into the conical hole of inner tube 102 and rigidly secured by a tail nut 152, which has a thin-walled part, carrying on the internal surface a set of electrical strain-gages 153, intended to sense the deformation of the thin-walled part of tail nut 152.

As shown in FIG. 1*c*, a front anvil assembly 170 is attached to the front part of housing 100 and secured to inner tube 102 by means of a threaded connection. Front anvil assembly 170 includes a disposable front anvil 143, made of hard shock-proof material, a stepped shank 144 having dynamic sealing O-rings 145 and 146; a tapered head 145 having a spiral 146; a threaded bushing 147; a disposable chisel 148; a dynamic sealing O-ring 149; a resilient bellows type diaphragm 171; a washer 150; a spring 151 which exerts outward thrust on stepped shank 144 and front guide sleeve 108. The components of front anvil assembly can be put together in the following order. Front anvil 143 is pressed into the hole in larger step of shank 144, than spring 151 and washer 150 are mounted on the smaller step of shank 144, which is then screwed against a stop into threaded bushing 147. After that, a hole is drilled through the assembly of shank 144 and bushing 147, and a pin 154 is pressed into this hole to prevent self-loosening of the assembly, which after that is inserted with a slide fit into front guide sleeve 108. Then, diaphragm 171 and O-ring 149 are placed in the appropriate groves on the smaller step of front guide 108, and then tapered head 145 is mounted with a slide fit on threaded bushing 147. And then tapered head 145 accommodates the smaller step of sleeve 108 and the collar of diaphragm 171. After all that, chisel 148 is screwed into bushing 147 against a stop on tapered head 145. Now front anvil assembly 170 can be assembled with housing assembly 100 by screwing front guide sleeve 108 against the stop on outer tube 103.

Referring to FIGS. 1*a*, 1*b*, 1*c*, and 8, the inside space between the front end of rear anvil 116 and rear end of striker assembly 104 represents a forward stroke chamber 201. The inside space between the front end of striker assembly 104 and the rear end of front anvil 143 represents a backward stroke chamber 202.

Referring to FIGS. 1*a*, 2–6, and 8, an electrically operated miniature air pressure transducer 155 is mounted on rear valve chest 131. Pressure transducer 155 is permanently connected through holes 156 and 157 with an internal space 203, which in its turn is connected with forward stroke chamber 201 through a hole 204 in follower 130. Thus, pressure transducer 155 is all the times connected with forward stroke chamber 201, in which during one cycle of machine operation the air pressure is changing from maximum to minimum values. These cyclic pressure changes in forward stroke chamber represent the operational frequency of machine 100. Pressure transducer 155 is sensing these pressure changes in forward stroke chamber and transmits through electrical wires (not shown in the drawing) corresponding signals to a portable electronic device, which transfers these signals into frequency readouts. Based on these readouts the operator will be able to make relevant decisions.

Figure 2:
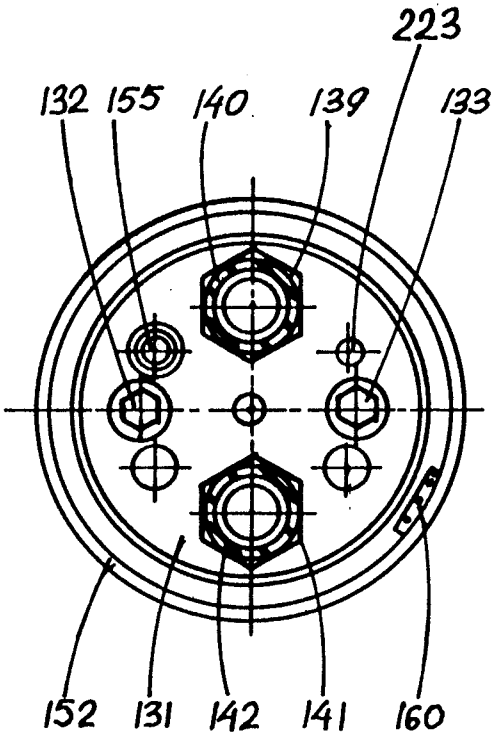
FIG. 2 is a left side view of the machine.

Referring now to FIGS. 1*a*, 2, and 8, a directional sensor 165 is combined with tail nut 152. A set of electrical strain-gages 153 are cemented to the internal surface of the thin-walled section of tail nut 152. The strain-gages are electrically connected in a way that no electrical signal is generated if each one of the strain-gages is equally deformed. However, an electrical signal will be generated if the strain-gages are unequally deformed. The bigger the difference in the deformation of the strain-gages the bigger is the generated signal. Obviously, the strain-gages should all have needed protection coverage. In order to protect the strain-gages, a short sleeve 159 is pressed into rear nut 152. Sleeve 159 has a slot to allow lead wires 158 to go from the strain-gages to a miniature electrical connector 160, secured to tail nut 152. Wires from connector 160 go to a portable electronic device which accepts the signals from the strain-gages.

When the machine penetrates rectilinearly, the lateral soil pressure on the thin-walled sector of tail nut 152 is uniform, and consequently, strain-gages will be equally deformed, and a zero signal will be transferred to the electronic device. In case the machine starts to deviate from the straight line trajectory, one part of the thin-walled sector will be more deformed than the other. In this case a signal will be transferred to the electronic device, which based on proper calibration, will interpret the signal in terms of angular deviation from the trajectory and also in terms of the radius of curvature of the trajectory of the machine. This information will help the operator decide to continue to go forward or switch over the machine to reverse mode operation.

B. Differential Air-Distributing Mechanism

B.1. Forward Mode Operation

Figure 9:
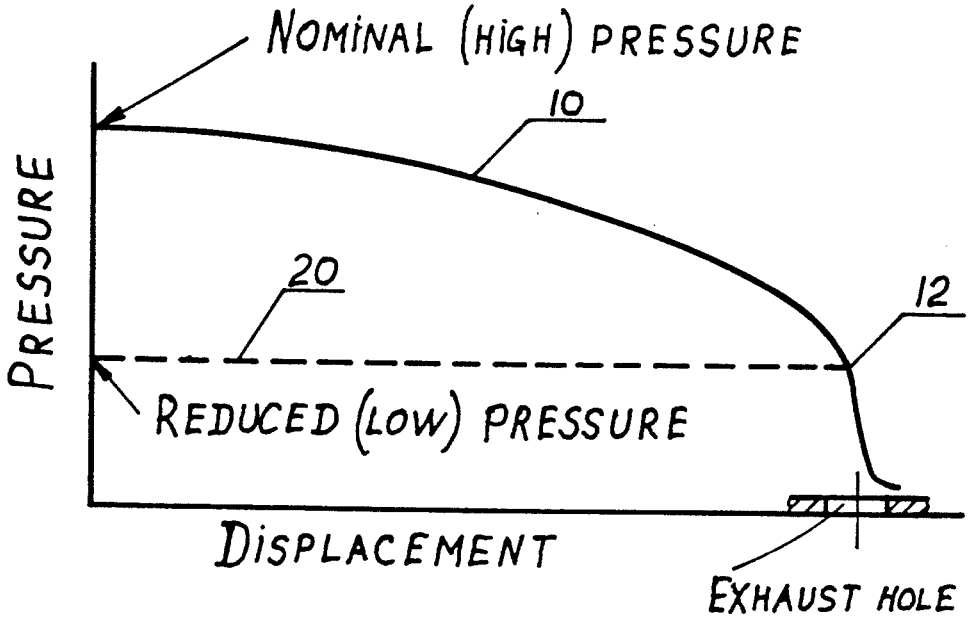
FIG. 9 represents graphs characterizing the air pressure applied to the right and left ends of the stroke control valve during the forward stroke of the striker in forward mode operation.

The relationship between air pressure inside forward stroke chamber 201 and the displacement of striker 104 during its forward stroke at forward mode operation of machine 100 is represented by curve 10 in FIG. 9. Curve 10 shows that the air pressure begins to drop essentially from its nominal (high) value shortly after striker 104 starts to move forward. When the rear end of striker 104 opens an exhaust hole 220, the pressure in forward stroke chamber 201 drops according the abrupt part of curve 10. The air pressure, reflected by curve 10, together with spring 129 are pushing stroke control valve 127 to the left. The value of the reduced (low) air pressure adjustable by a conventional pressure regulator, applied all the times at forward mode operation during the forward and backward strokes of striker 104 to the left end of stroke control valve 127 is represented by a dotted line 20 in FIG. 9. Thus, a pressure force, corresponding to the reduced (low) air pressure and directed to the right, is permanently applied to the left end of stroke control valve 127. As it is illustrated in FIG. 9, most of the time during the forward stroke of striker 104 the air pressure value inside forward stroke chamber 201 significantly exceeds the value of the reduced (low) air pressure. Thus, a pressure force, corresponding to the nominal (high) air pressure and directed to the left, is applied to the right end of stroke control valve 127. The difference of these forces results in a force directed to the left most of the time during the forward stroke of striker 104 (not counting spring 129) and holds stroke control valve 127 in its extreme left position. In this case, compressed air will flow into forward stroke chamber 201, accelerating striker 104 during its entire forward stroke, while backward stroke chamber 202 will be connected to the atmosphere, and the reduced (low) air pressure line will be trapped. When striker 104, almost at the end of its forward stroke, opens exhaust hole 220 (FIGS. 1*b* and 9), the pressure inside forward stroke chamber 201 drops below point 12 (FIG. 9). This enables the reduced (low) air pressure to move stroke control valve 127 to its extreme right position, at which the compressed air at the reduced (low) pressure will flow into backward stroke chamber 202, enabling striker 104 to perform its backward stroke, while the nominal (high) air pressure line is trapped, and forward stroke chamber 201 is connected to the atmosphere through a calibrated orifice 223 (FIG. 8) in order to create an air buffer which will brake to some extent striker 104 during its backward stroke. At the end of the backward stroke, striker 104 pushes follower 130 to the left and imparts a slight impact to rear anvil 116. Follower 130 pushes stroke control valve 127 to the left, and striker 104 begins the forward stroke.

During forward mode operation the nominal (high) pressure line does not need any adjustments.

All air passages and other details associated with the operation of the differential air-distributing mechanism are indicated below in the description of the machine operation during forward mode operation.

B.2. Reverse Mode Operation

Figure 10:
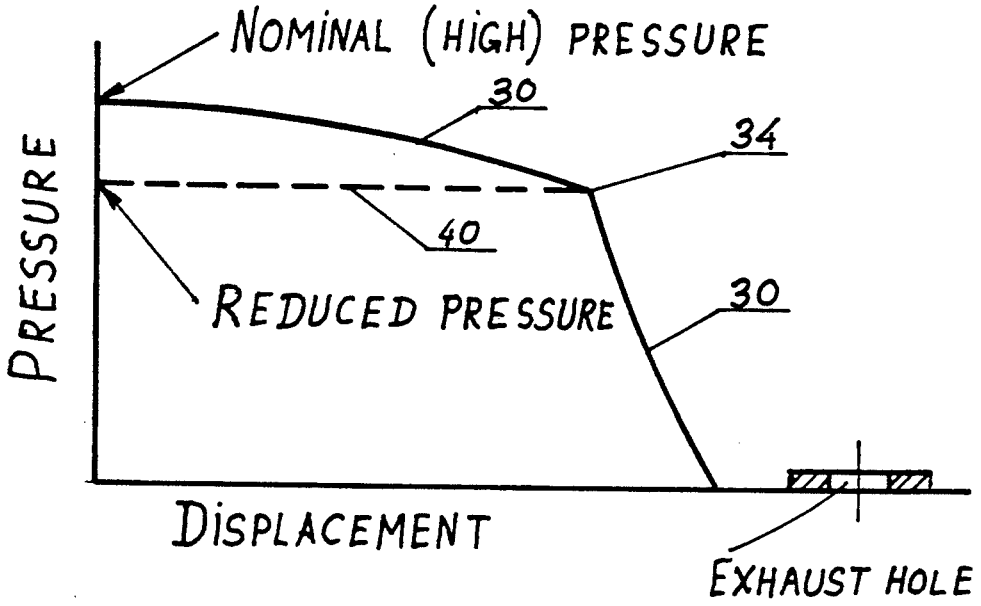
FIG. 10 represents graphs, characterizing the air pressure applied to the right and left ends of the stroke control valve during the forward stroke of the striker in reverse mode operation.

The relationship between air pressure inside forward stroke chamber 201 and displacement of striker 104 during its forward stroke at reverse mode operation of machine 100 is presented by curve 30 in FIG. 10. The value of the reduced air pressure applied at all times to the left end of stroke control valve 127 at reverse mode operation is reflected by a dotted line 40 in FIG. 10. As it can be seen by comparing FIGS. 9 and 10, the value of the reduced air pressure at reverse mode operation essentially exceeds the value of reduced (low) pressure at forward mode operation. It is obvious that stroke control valve 127 will be held in its extreme left position until the pressure inside forward stroke chamber 201 will be above the level of point 34 (FIG. 10). When the pressure inside forward stroke chamber 201 drops below the level of point 34, the reduced air pressure becomes sufficient enough to move stroke control valve 127 to its extreme right position. As shown in FIG. 10, this happens when striker 104 is still far away from front anvil 143 (FIG. 1*c*). Now the compressed air at reduced pressure is flowing into backward stroke chamber 202 intensively braking striker 104. The nominal (high) pressure line is trapped now, and forward stroke chamber 201 is connected to the atmosphere through a longitudinal hole 224 (FIG. 8). The value of the reduced pressure for reverse mode operation should be properly adjusted by the pressure regulator so that striker 104 is stopped before it reaches front anvil 143. (Light impacts to front anvil 143 are allowed). After its stop, striker 104 begins its backward stroke being accelerated by the reduced air pressure flow. At the end of its backward stroke striker 104 pushes follower 130 to the left, which in its turn pushes stroke control valve 127 to the left, and striker 104 imparts an impact to rear anvil 116. Stroke control valve 127 moves to its extreme left position and the forward stroke of striker 104 begins.

A certain reduction of pressure value in the nominal (high) air pressure line may improve the performance of the machine during reverse mode operation.

All air passages and other details associated with the operation of the differential air-distributing mechanism in reverse mode operation are indicated below in the description of reverse mode operation of machine 100.

C. Start of the Machine

Consider the start of machine 100. When hoses 140 and 142 are depressurized, stroke control valve 127 is moved by spring 129 to the extreme left position, and follower 130 is moved by the same spring to the extreme right position (FIGS. 1*a* and 8). Striker 104 may be located in any position between rear anvil 116 and front anvil 143. The air supply to hoses 140 and 142 may be controlled by one or two air valves. When the air valves are open, compressed air at nominal (high) pressure through hose 140, barb 139 and longitudinal holes 205, 206, and radial hole 207 will flow into an annular space 208, and then through radial holes 209, longitudinal hole 210, space 203 and longitudinal hole 204 will flow into forward stroke chamber 201 (FIG. 1*a*). Compressed air at reduced (low) pressure through hose 142, barb 141, longitudinal hole 211, port 212, annular space 213, port 214, and longitudinal hole 215 will simultaneously come into spaces 216 and 217, and also through longitudinal hole 218 will come to a radial hole 219 (FIG. 1*a*). The cross-sectional areas of the opposite ends of stepped stroke control valve 127, disposed from one side to the action of nominal (high) pressure and from the other to reduced (low) pressure, are equal. Consequently, the forces, pushing stroke control valve 127 to the left, will exceed the forces, pushing it to the right, and stroke control valve 127 will continue to be in its extreme left position, at which radial hole 219 is overlapped and the reduced (low) pressure air is trapped. The compressed air in space 217 may move or not move relief valve 136. This does not affect the distribution of the compressed air in the system. Thus, the compressed air at nominal (high) pressure will flow into forward stroke chamber 201, pushing striker 104 forward. A short instant before striker 104 imparts an impact to front anvil 143 it will open exhaust hole 220 (FIG. 1*b*) and forward stroke chamber 201 will become connected with the atmosphere. The air pressure in forward stroke chamber will drastically drop, and the reduced (low) pressure, acting in space 216, will move stroke control valve 127 to the extreme right position, in which hole 207 will be overlapped while hole 219 will be connected with hole 221 through an annular space 222. Now the nominal (high) pressure air is trapped while the reduced (low) pressure air flows through hole 221, channel 114 (FIG. 1*a*) and port 223 (FIG. 1*c*) into backward stroke chamber 202, pushing striker 104 backwards. At the end of its backward stroke, striker 104 pushes follower 130 which in its turn pushes stroke control valve 127 to its left position, and a forward stroke of striker 104 begins.

In case striker 104 is located too close to front anvil 143 before starting, the pressure in forward stroke chamber at the start may immediately drastically drop, so that the reduced (low) pressure air will move stroke control valve 127 to the right, beginning the backward stroke of striker 104.

D. Forward Mode Operation of the Machine and Adjustment of Reduced (Low) Pressure All the components in the drawing are shown in the position at which striker 104 performs the forward stroke at forward mode operation.

Set up zero pressure on the pressure regulator which controls the pressure in the reduced (low) air pressure line. Open the valves of the nominal (high) and reduced (low) air pressure lines. Obviously, the reduced (low) air pressure line will be depressurized. The compressed air at nominal (high) pressure will start to flow into forward stroke chamber 201 through hose 140, barb 139, longitudinal holes 205, 206, radial hole 207, annular space 208, radial holes 209, longitudinal hole 210, space 203, and longitudinal hole 204 (FIG. 1*a*). Striker 104 will move forward, while stroke control valve 127 will be held in its extreme left position by spring 129 and air pressure in space 208 and in forward stroke chamber 201. There will not be any forces pushing stroke control valve 127 to the right. When stroke control valve 127 is in the extreme left position, backward stroke chamber 202 is connected to the atmosphere through port 223, channel 114, radial hole 225, annular space 222, radial hole 226, longitudinal holes 227 and 224 (FIGS. 1*a*, 1*b*, 1*c*, 6, and 8). At the end of the forward stroke, striker 104 will impart an impact to front anvil 143 and will remain in its extreme right position, being pushed by the air flow in forward stroke chamber 201. A short instant before striker 104 reaches its extreme right position, exhaust hole 220 connects forward stroke chamber 201 with the atmosphere through channel 115, radial holes 228, 229, 230, 231, and exhaust holes 227, 232, 233, 234, 224, 236, 237, 238, radial holes 239, 240, 241, 242, and annular space (FIGS. 1*a*, 1*b*, 2–6, and 8). The air pressure inside forward stroke chamber 201 drastically drops. Now start rotating the pressure control screw of the pressure regulator gradually increasing the pressure in the reduced (low) air pressure line. Compressed air at reduced (low) pressure will start to flow through hose 142, barb 141, longitudinal hole 211, port 212, annular space 213, and longitudinal hole 215 into spaces 216 and 217, and also through longitudinal hole 218 to radial hole 219, which is still overlapped by stroke control striker 127 (FIG. 1*a*). Increasing the pressure in the reduced (low) air pressure line results in a situation, when the forces, pushing stroke control valve 127 to the right, exceed the forces, pushing it to the left. When stroke control valve 127 is moved to its extreme right position, the backward stroke of striker 104 begins, and machine 100 starts its cyclic working process. At this moment the pressure in the reduced (low) air pressure line is basically already adjusted. However, an additional fine adjustment may improve the performance of machine 100.

For the prototypes tested, the nominal (high) pressure was 100 psi., and the reduced (low) pressure was about 40 psi.

As it is shown in FIG. 1*a*, the air at the reduced (low) pressure comes to space 217, pushing relief valve 136 to the left. However, the reduced (low) air pressure force is essentially less than the force developed by spring 138, so that relief valve during the forward mode operation is held in its extreme right position.

When stroke control valve 127 is moved to its extreme right position, the reduced (low) pressure air is flowing into backward stroke chamber 202 through radial hole 219, space 222, radial hole 221, channel 114, and port 223, pushing striker 104 to the left (FIGS. 1*a* and 1*c*). In this situation, forward stroke chamber 201 is connected with the atmosphere through longitudinal hole 204, space 203, longitudinal hole 210, radial holes 209, space 243, radial hole 244, longitudinal holes 245 and 246, and calibrated orifice 223 (FIGS. 1*a*, 3–6, and 8). Calibrated orifice 223 is intended to restrict the motion of striker 104 in order to decrease the impact energy of striker 104 to a certain level during its backward stroke. At the end of the backward stroke, striker 104 opens an exhaust port 247 (FIG. 1*b*), connecting backward stroke chamber 202 with the atmosphere through the same passages as for the exhaust from forward stroke chamber 201, and also pushes follower 130 to the left, which in its turn pushes stroke control valve 127 to the left, and forward stroke of striker 104 begins. Nominal (high) pressure air is now flowing into forward stroke chamber 201 while backward stroke chamber 202 remains to be connected with the atmosphere. Striker 104 is gaining the kinetic energy during its forward stroke and imparts an impact to front anvil 143, after that the backward stroke begins as described above, and then the cycle repeats itself.

Spiral 146, which is secured to tapered head 145, interacts with the soil during machine penetration and exerts a twist loading on the soil. As a result, machine 100 is slowly rotating around its longitudinal axis during the forward mode operation. This ensures a uniform wear of the movable components (bushings, valve) of machine 100. The direction of spiral 146 should increase the thread tightening of front guide sleeve 108.

E. Reverse Mode Operation of the Machine and Adjustment of the Reduced Pressure

In order to switch over machine 100 from forward mode operation to reverse mode operation, it is necessary to increase the pressure in the reduced (low) air pressure line to a certain level between the low pressure and the nominal (high) pressure by the help of the pressure regulator. When machine 100 begins to intensively move backward, the reduced air pressure is adjusted properly. There is no need to stop machine 100 in order to switch over from forward stroke operation to reverse mode operation and vice versa. The reduced air pressure for the reverse mode operation was about 80 psi for the prototypes tested. All air passages are used the same way for forward and reverse mode operation. The only difference is associated with relief valve 136, which will be pushed to its extreme left position by the reduced air pressure. In this case, as it can be seen in FIGS. 4 and 8, an annular space 248 is connected with a radial hole 249, which in its turn is connected with longitudinal hole 224, which is always connected with the atmosphere through radial hole 239 and annular space 243. Thus, when relief valve 136 is in its extreme left position, an additional passage is connecting forward stroke chamber 201 with the atmosphere during backward stroke of striker 104 in order to eliminate the motion restriction imposed by calibrated orifice 223 on striker 104. At this condition, striker 104 will be intensively accelerated during its backward stroke, maintaining a high efficiency during reverse mode operation.

I claim:

1. A differential pneumopercussive self-propelled reversible soil penetrating machine, comprising:

an elongated compound housing assembly, including concentrically mounted outer and inner tubes creating an essential annular space between the external surface of said inner tube and internal surface of said outer tube, front and rear guide sleeves which are mounted on the threaded ends of said inner tube and maintain the concentricity of said outer and inner tubes by means of centering surfaces, two longitudinal strips secured to the external surface of said inner tube parallel to the longitudinal axis of said inner tube dividing said annular space between said outer and inner tubes into two unequal hermetically insulated from each other longitudinal channels, the smaller of which is alternately connected with the atmosphere or connected with compressed air supply while the larger of which is always connected with the atmosphere, and means to prevent bending of said inner tube in case when said smaller channel is connected with the atmosphere;

a rear anvil assembly disposed inside the rear part of said inner tube and rigidly secured to said inner tube in order to prevent impact loading on all components of said machine located behind said rear anvil assembly, including a rear anvil having a central longitudinal stepped hole, and means for rigidly securing said rear anvil to said inner tube;

a moveable chisel assembly secured by said front guide sleeve to the front part of said compound housing, including a disposable front stepped anvil, an elastic link, a stepped shank slidably disposed inside front part of said inner tube and accommodating the tail part of said disposable front anvil and also carrying said elastic link, a set of dynamic resilient sealing O-rings mounted in appropriate grooves on the larger step of said shank for preventing air leakage through the front part of said inner tube, a tapered head with a spiral mounted on it for developing a torque to twist said machine during its forward mode operation in order to ensure a uniform wear of the moveable components, a disposable tapered chisel representing the front part of said machine, a threaded bushing slidably disposed inside said front guide sleeve and carrying said tapered head and also connecting said stepped shank with said disposable chisel, a resilient bellows type diaphragm located between said front guide sleeve and said tapered head for preventing soil penetration into the gaps between moveable components, a dynamic sealing O-ring mounted in the groove on the smaller step of said front guide sleeve for sealing the slide fit between said front guide sleeve and said tapered head, and means to secure the threaded connections from loosening;

a striker assembly slidably disposed inside said inner tube for reciprocation and impacting against said rear anvil and said front anvil creating a forward stroke chamber between its rear end and front end of said rear anvil and a backward stroke chamber between its front end and rear end of said front anvil, including a striker having on both ends hollow journals, two bushings pressed on said hollow journals and having a slide fit with said inner tube, and two disposable bits pressed into said hollow journals; and a differential air-distributing mechanism secured into the rear part of said compound housing remotely from said rear anvil providing pneumatically control of the reciprocating motion of said striker which during forward mode operation of said machine is accelerated without restriction in order to impart an impact to said front anvil and is restricted to impart a slight impact to said rear anvil and during reverse mode operation of said machine is braked to avoid an impact to said front anvil or restricted to impart a slight impact to said front anvil and is accelerated without restriction in order to impart an impact to said rear anvil, including an adjustable by a pressure regulator nominal (high) air pressure line, an adjustable by a pressure regulator reduced (low) air pressure line, a rear valve chest carrying two barbs for hoses for said air lines, a spring loaded relief valve slidably disposed inside said rear chest for connecting by an additional air passage said forward stroke chamber with the atmosphere at the backward stroke of said striker during reverse mode operation of said machine, a coil spring disposed inside said rear valve chest to push said relief valve to its extreme right position, a front valve chest assembled with said inner tube by a conical fit, a hollow stepped bushing accommodated by said rear and front valve chests and centering said rear and front valve chests, a stepped stroke control valve slidably disposed inside said front valve chest, a hollow follower slidably disposed inside said rear anvil, a coil spring disposed in longitudinal central holes of said stepped stroke control valve and said follower and simultaneously loading said stepped stroke control valve and said follower in opposite directions, a tail nut securing said differential air-distributing mechanism to said compound housing, and alignment and securing means.

2. The machine of claim 1, wherein said rear valve chest and said front valve chest have a series of longitudinal coinciding holes used for delivery and exhaust of compressed air.

3. The machine of claim 1, wherein said inner tube and said front valve chest have a series of coinciding radial holes communicating with said longitudinal holes of said front and rear valve chests.

4. The machine of claim 1, wherein said smaller longitudinal channel is alternately connecting said backward stroke chamber with the atmosphere during forward stroke of said striker or connecting said backward stroke chamber to said reduced (low) pressure air line during backward stroke of said striker.

5. The machine of claim 1, wherein said rear valve chest has a calibrated orifice connecting said forward stroke chamber with the atmosphere at backward stroke of said striker during forward mode operation of said machine in order to restrict the motion of said striker.

6. The machine of claim 1, wherein said stepped stroke control valve being in its extreme left position creates together with said front valve chest an annular space connected by a radial port in said front valve chest with said nominal (high) air pressure line.

7. The machine of claim 1, wherein said stepped stroke control valve has a series of radial holes connected with its central longitudinal hole and communicating with said annular space when said stepped stroke control valve is in its extreme left position.

8. The machine of claim 1, wherein said radial holes and said central longitudinal hole of said stepped stroke control valve are alternately connecting said forward stroke chamber with said nominal (high) air pressure line or with the atmosphere.

9. The machine of claim 1, wherein said stepped control valve being in its extreme left position connects said forward stroke chamber with said nominal (high) air pressure line through said radial and said longitudinal holes in said valve and said follower, traps said reduced (low) air pressure line by overlapping front radial holes in said front valve chest and connects said backward stroke chamber with the atmosphere through said radial port in said inner tube, said smaller longitudinal channel, and said coinciding radial holes in said inner tube and said front valve chest, an annular groove on said stepped stroke control valve, and said coinciding radial and longitudinal holes in said inner tube and said front and rear valve chests, and wherein said stepped control valve being in its extreme right position overlaps said radial port in said front valve chest eliminating supply of nominal (high) air pressure into said forward stroke chamber and connects said forward stroke chamber with the atmosphere through said central longitudinal hole and said radial holes in said stepped stroke control valve and an annular groove in said front valve chest and also through said coinciding radial holes of said front valve chest and said inner tube, and also connects said backward stroke chamber with said reduced (low) pressure air line through said coinciding longitudinal holes in said rear and front valve chests, said front radial ports in said front valve chest, said annular groove on said stepped stroke control valve, radial hole in said inner tube, said smaller longitudinal channel, and radial port in said inner tube.

10. The machine of claim 1, wherein the left end of said stepped stroke control valve during all modes operation of said machine is disposed to the pressure of said reduced (low) air pressure line.

11. The machine of claim 1, wherein during the forward stroke of said striker the right end of said stepped stroke control valve is disposed to the pressure of nominal (high) air pressure line.

12. The machine of claim 1, wherein the cross-sectional area of said stepped stroke control valve disposed to said reduced (low) air pressure line equals the cross-sectional area disposed to said nominal (high) air pressure line and, consequently, the forces, including the force of said spring, pushing said stepped stroke control valve to the left essentially exceed the forces pushing said valve to the right so that the difference between said forces is resulting in a force which reliably holds said stepped stroke control valve in its extreme left position allowing for a non-restricted and almost unlimited by length forward stroke of said striker during forward mode operation of said machine.

13. The machine of claim 1, wherein shortly before the end of the forward stroke of said striker, an exhaust port becomes open causing a drastic air pressure drop in said forward stroke chamber enabling the difference in the forces applied to the both ends of said stepped stroke control valve to move said valve to its extreme right position at which the backward stroke of said striker begins.

14. The machine of claim 1, wherein at the end of the backward stroke, said striker pushes to the left said follower which compresses said coil spring pushing said stepped stroke control valve to the left, and all this causes said stepped stroke control valve to move to its extreme left position resulting in beginning of forward stroke of said striker.

15. The machine of claim 1, wherein the switching over from forward mode operation to reverse mode operation and vise versa is achieved by an appropriate adjustment of the air pressure in said reduced (low) air pressure line by means of a conventional air pressure regulator during the operation of said machine or when said machine is stopped.

16. The machine of claim 1, wherein the value of the air pressure in said reduced (low) air pressure line during the forward mode operation is lesser than during the reverse mode operation.

17. The machine of claim 1, wherein due to gradual air pressure drop in said forward stroke chamber during the forward stroke of said striker, it is possible to move said stepped stroke control valve to its extreme right position before said striker opens said exhaust port in said inner tube in case the difference between the air pressure values in said nominal (high) and reduced (low) air pressure lines is relatively small which is used in said machine for switching over from forward to reverse modes operation.

18. A differential pneumopercussive self-propelled reversible soil penetrating machine, comprising:

an elongated compound housing assembly, including concentrically mounted outer and inner tubes creating an essential annular space between the external surface of said inner tube and internal surface of said outer tube, front and rear guide sleeves which are mounted on the threaded ends of said inner tube and maintain the concentricity of said outer and inner tubes by means of centering surfaces, two longitudinal strips secured to the external surface of said inner tube parallel to the longitudinal axis of said inner tube dividing said annular space between said outer and inner tubes into two unequal hermetically insulated from each other longitudinal channels, the smaller of which is alternately connected with the atmosphere or connected with compressed air supply while the larger of which is always connected with the atmosphere, and means to prevent bending of said inner tube in case when said smaller channel is connected with the atmosphere;

a rear anvil assembly disposed inside the rear part of said inner tube and rigidly secured to said inner tube in order to prevent impact loading on all components of said machine located behind said rear anvil assembly, including a rear anvil having a central longitudinal stepped hole, and means for rigidly securing said rear anvil to said inner tube;

a moveable chisel assembly secured by said front guide sleeve to the front part of said compound housing, including a disposable front stepped anvil, an elastic link, a stepped shank slidably disposed inside front part of said inner tube and accommodating the tail part of said disposable front anvil and also carrying said elastic link, a set of dynamic resilient sealing O-rings mounted in appropriate grooves on the larger step of said shank for preventing air leakage through the front part of said inner tube, a tapered head with a spiral mounted on it for developing a torque to twist said machine during its forward mode operation in order to ensure a uniform wear of the moveable components, a disposable tapered chisel representing the front part of said machine, a threaded bushing slidably disposed inside said front guide sleeve and carrying said tapered head and also connecting said stepped shank with said disposable chisel, a resilient bellows type diaphragm located between said front guide sleeve and said tapered head for preventing soil penetration into the gaps between moveable components, a dynamic sealing O-ring mounted in the groove on the smaller step of said front guide sleeve for sealing the slide fit between said front guide sleeve and said tapered head, and means to secure the threaded connections from loosening;

a striker assembly slidably disposed inside said inner tube for reciprocation and impacting against said rear anvil and said front anvil creating a forward stroke chamber between its rear end and front end of said rear anvil and a backward stroke chamber between its front end and rear end of said front anvil, including a striker having on both ends hollow journals, two bushings pressed on said hollow journals and having a slide fit with said inner tube, and two disposable bits pressed into said hollow journals;

a differential air-distributing mechanism secured into the rear part of said compound housing remotely from said rear anvil providing pneumatically control of the reciprocating motion of said striker which during forward mode operation of said machine is accelerated without restriction in order to impart an impact to said front anvil and is restricted to impart a slight impact to said rear anvil and during reverse mode operation of said machine is braked to avoid an impact to said front anvil or restricted to impart a slight impact to said front anvil and is accelerated without restriction in order to impart an impact to said rear anvil, including an adjustable by a pressure regulator nominal (high) air pressure line, an adjustable by a pressure regulator reduced (low) air pressure line, a rear valve chest carrying two barbs for hoses for said air lines, a spring loaded relief valve slidably disposed inside said rear chest for connecting by an additional air passage said forward stroke chamber with the atmosphere at the backward stroke of said striker during reverse mode operation of said machine, a coil spring disposed inside said rear valve chest to push said relief valve to its extreme right position, a front valve chest assembled with said inner tube by a conical fit, a hollow stepped bushing accommodated by said rear and front valve chests and centering said rear and front valve chests, a stepped stroke control valve slidably disposed inside said front valve chest, a hollow follower slidably disposed inside said rear anvil, a coil spring disposed in longitudinal central holes of said stepped stroke control valve and said follower and simultaneously loading said stepped stoke control valve and said follower in opposite directions, a tail nut securing said differential air-distributing mechanism to said compound housing, and alignment and securing means; and a frequency sensor including a miniature air pressure transducer mounted on the rear part of said rear valve chest and connected with said forward stroke chamber by a longitudinal hole drilled in said rear and front valve chests which is generating an electrical signal corresponding to the frequency of said machine operation, electrical wires transmitting this signal to a portable electronic device which converts the signal into frequency readouts.

19. A differential pneumopercussive self-propelled reversible soil penetrating machine, comprising:

an elongated compound housing assembly, including concentrically mounted outer and inner tubes creating an essential annular space between the external surface of said inner tube and internal surface of said outer tube, front and rear guide sleeves which are mounted on the threaded ends of said inner tube and maintain the concentricity of said outer and inner tubes by means of centering surfaces, two longitudinal strips secured to the external surface of said inner tube parallel to the longitudinal axis of said inner tube dividing said annular space between said outer and inner tubes into two unequal hermetically insulated from each other longitudinal channels, the smaller of which is alternately connected with the atmosphere or connected with compressed air supply while the larger of which is always connected with the atmosphere, and means to prevent bending of said inner tube in case when said smaller channel is connected with the atmosphere;

a rear anvil assembly disposed inside the rear part of said inner tube and rigidly secured to said inner tube in order to prevent impact loading on all components of said machine located behind said rear anvil assembly, including a rear anvil having a central longitudinal stepped hole, and means for rigidly securing said rear anvil to said inner tube;

a moveable chisel assembly secured by said front guide sleeve to the front part of said compound housing, including a disposable front stepped anvil, an elastic link, a stepped shank slidably disposed inside front part of said inner tube and accommodating the tail part of said disposable front anvil and also carrying said elastic link, a set of dynamic resilient sealing O-rings mounted in appropriate grooves on the larger step of said shank for preventing air leakage through the front part of said inner tube, a tapered head with a spiral mounted on it for developing a torque to twist said machine during its forward mode operation in order to ensure a uniform wear of the moveable components, a disposable tapered chisel representing the front part of said machine, a threaded bushing slidably disposed inside said front guide sleeve and carrying said tapered head and also connecting said stepped shank with said disposable chisel, a resilient bellows type diaphragm located between said front guide sleeve and said tapered head for preventing soil penetration into the gaps between moveable components, a dynamic sealing O-ring mounted in the groove on the smaller step of said front guide sleeve for sealing the slide fit between said front guide sleeve and said tapered head, and means to secure the threaded connections from loosening;

a striker assembly slidably disposed inside said inner tube for reciprocation and impacting against said rear anvil and said front anvil creating a forward stroke chamber between its rear end and front end of said rear anvil and a backward stroke chamber between its front end and rear end of said front anvil, including a striker having hollow journals on both ends, two bushings pressed on said hollow journals and having a slide fit with said inner tube, and two disposable bits pressed into said hollow journals;

a differential air-distributing mechanism secured into the rear part of said compound housing remotely from said rear anvil providing pneumatically control of the reciprocating motion of said striker which during forward mode operation of said machine is accelerated without restriction in order to impart an impact to said front anvil and is restricted to impart a slight impact to said rear anvil and during reverse mode operation of said machine is braked to avoid an impact to said front anvil or restricted to impart a slight impact to said front anvil and is accelerated without restriction in order to impart an impact to said rear anvil, including an adjustable by a pressure regulator nominal (high) air pressure line, an adjustable by a pressure regulator reduced (low) air pressure line, a rear valve chest carrying two barbs for hoses for said air lines, a spring loaded relief valve slidably disposed inside said rear chest for connecting by an additional air passage said forward stroke chamber with the atmosphere at the backward stroke of said striker during reverse mode operation of said machine, a coil spring disposed inside said rear valve chest to push said relief valve to its extreme right position, a front valve chest assembled with said inner tube by a conical fit, a hollow stepped bushing accommodated by said rear and front valve chests and centering said rear and front valve chests, a stepped stroke control valve slidably disposed inside said front valve chest, a hollow follower slidably disposed inside said rear anvil, a coil spring disposed in longitudinal central holes of said stepped stroke control valve and said follower and simultaneously loading said stepped stoke control valve and said follower in opposite directions, a tail nut securing said differential air-distributing mechanism to said compound housing, and alignment and securing means;

a frequency sensor including a miniature air pressure transducer mounted on the rear part of said rear valve chest and connected with said forward stroke chamber by a longitudinal hole drilled in said rear and front valve chests which is generating an electrical signal corresponding to the frequency of said machine operation, electrical wires transmitting this signal to a portable electronic device which converts the signal into frequency readouts; and a directional sensor, including electrical strain-gages cemented to the internal surface of a thin-walled part of said tail nut and electrically connected to each other in order to generate an electrical signal proportional to the difference in deformation of said strain-gages, which appears when said thin-walled part of said tail nut is not uniformly deformed by compressed soil as a result of deviation of said machine from rectilinear trajectory during its operation, electrical means connecting said transducer with an electronic device which accepts the signal and converts it into appropriate readouts characterizing the curvature of the trajectory.

* * * * *